US010903603B2

(12) United States Patent
Michelmann et al.

(10) Patent No.: US 10,903,603 B2
(45) Date of Patent: Jan. 26, 2021

(54) ELECTRICAL CONNECTOR

(71) Applicant: Rosenberger Hochfrequenztechnik GmbH & Co. KG, Fridolfing (DE)

(72) Inventors: Folke Michelmann, Tittmoning (DE); Markus Schichl, Seekirchen (AT); Herbert Wurm, Tittmoning (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 107 days.

(21) Appl. No.: 16/304,082

(22) PCT Filed: May 2, 2017

(86) PCT No.: PCT/EP2017/000545
§ 371 (c)(1),
(2) Date: Nov. 21, 2018

(87) PCT Pub. No.: WO2017/207082
PCT Pub. Date: Dec. 7, 2017

(65) Prior Publication Data

US 2020/0161805 A1 May 21, 2020

(30) Foreign Application Priority Data

Jun. 2, 2016 (DE) ..... 10 2016 006 775

(51) Int. Cl.
*H01R 13/627* (2006.01)
*H01R 13/26* (2006.01)
*H01R 13/62* (2006.01)

(52) U.S. Cl.
CPC ..... *H01R 13/6271* (2013.01); *H01R 13/26* (2013.01); *H01R 13/6205* (2013.01); *H01R 13/6277* (2013.01)

(58) Field of Classification Search
CPC ..... H01R 13/6271; H01R 13/26; H01R 13/6205; H01R 13/6277
(Continued)

(56) References Cited

U.S. PATENT DOCUMENTS 9,876,310 B2 * 1/2018 Hashiguchi ..... H01R 13/6205
10,177,491 B2 * 1/2019 Davies ..... H01R 13/629
2009/0275232 A1 11/2009 Zhu et al.

FOREIGN PATENT DOCUMENTS

CN 104979710 A 10/2015
DE 20104862 U1 8/2001
(Continued)

*Primary Examiner* — Renee S Luebke
*Assistant Examiner* — Paul D Baillargeon
(74) *Attorney, Agent, or Firm* — David P. Dickerson

(57) ABSTRACT

The present invention relates to an electrical connector comprising a first connector portion, a second connector portion and a locking mechanism, wherein the first connector portion has a first electrical contact element and at least one magnet, and wherein the second connector portion has a second electrical contact element and at least one second magnet with a polarity which is reversed in relation to the first magnet, wherein the first and the second contact element are designed to establish an electrical connection between the first and the second connector portion for power and/or data transmission, and wherein the locking mechanism is of self-locking design.

22 Claims, 4 Drawing Sheets

(58) Field of Classification Search
USPC ..... 439/10, 342, 343
See application file for complete search history.

(56) References Cited

FOREIGN PATENT DOCUMENTS

| | | | |
|---|---|---|---|
| DE | 10206310 | A1 | 8/2002 |
| DE | 102005003386 | B3 | 6/2006 |
| DE | 2006020263 | U1 | 4/2008 |
| TW | M350111 | U | 2/2009 |
| TW | M432988 | U | 7/2012 |
| TW | M453993 | U | 5/2013 |
| TW | M521283 | U | 5/2016 |
| WO | 2008068241 | A1 | 6/2008 |

* cited by examiner

ELECTRICAL CONNECTOR

FIELD OF THE INVENTION

The present invention relates to an electrical connector, to an operating method for an electrical connector, and also to a support comprising an electrical connector.

TECHNICAL BACKGROUND

DE 20 2006 020 263 U1 discloses an electrical connecting system. Connecting systems of this kind are used for power and data or signal transmission and, to this end, generally have a large number of contact elements which, when the connecting system is closed, are connected to corresponding mating contact elements. The contact elements can be arranged in a plug and the mating contact elements can be arranged in a socket. In order for the contact elements to make contact with the mating contact elements without problems, magnets which are aligned with one another are inserted in the plug and in the socket. In this case, the magnets in the plug and in the socket attract one another and ensure that the plug is magnetically connected to the socket and, in the process, the contact elements make contact with the mating contact elements. In general, two magnets are provided in the plug and, respectively, two magnets are provided in the socket.

The use of magnets and opposing magnets has been found to be particularly suitable in order firstly to establish a secure connection between the contact elements and the mating contact elements and secondly to facilitate the connecting process. Connecting systems of this kind may also be self-locating within certain limits.

Although magnets in a connector facilitate plug-connection of the individual connector portions, it may be necessary to additionally secure the connector in safety-critical fields of application or in fields of application with mechanical loads or vibrations.

Various locking mechanisms, for example screws and thread, are known to a person skilled in the art for this purpose. However, this has proven to be complicated when plug-connecting the connector.

This is a state which is in need of improvement.

SUMMARY OF THE INVENTION

Against this background, the present invention aims to provide an improved self-locating electrical connector.

This object is addressed by the embodiments recited in the independent claims. Further embodiments are recited in the dependent claims.

Among other embodiments, the present disclosure teaches an electrical connector comprising a first connector portion, a second connector portion and a locking mechanism, wherein the first connector portion has a first electrical contact element and at least one magnet, wherein the second connector portion has a second electrical contact element and at least one second magnet with a polarity which is reversed in relation to the first magnet, wherein the first and the second contact element are designed to establish an electrical connection between the first and the second connector portion for power and/or data transmission, and wherein the locking mechanism is of self-locking design.

The present disclosure moreover teaches an operating method for an electrical magnetic connector comprising a first connector portion and a second connector portion, which operating method comprises the following steps:

moving the first connector portion toward the second connector portion from a closing direction; establishing an electrical connection between the first connector portion and the second connector portion; self-locking of the first connector portion to the second connector portion by a locking mechanism; turning the second connector portion or the locking element into an opening position or moving the second connector portion in an opening direction; and disconnecting the electrical connector.

In the context of the present disclosure, the term "lock" may be understood to mean that the connector cannot be released owing to an undefined movement of the or at the first or the second connector portion or owing to an undefined action of force onto the first or the second connector portion.

Accordingly, the term "unlock" may also be understood to mean, specifically, that a blocked connection can be released solely owing to an undefined action of force onto the first or the second connector portion. This does not have to require a separate direct or indirect operation of an unlocking mechanism, but rather can also be an effect which is inherent to the connector.

The idea on which the present invention is based involves providing a particularly user-friendly electrical connector by virtue of the connector having magnets which ensure self-location of the connectors. The magnetic connection is furthermore secured by an automatic locking mechanism.

Advantageous refinements and developments can be found in the further dependent claims and also in the description with reference to the figures of the drawing.

According to a preferred embodiment of the invention, a locking arrangement can be unlocked by moving and/or turning the first and/or the second connector portion in a predetermined opening direction. For example, it is conceivable that the connector portion or part of the connector portion has to be turned to a certain position for unlocking purposes. It is particularly advantageous if an action of force in a predetermined direction, for example by pulling downward, has to be performed for unlocking purposes.

In this way, the connector is adequately secured against mechanical loads and vibrations which occur. Furthermore, the described unlocking is particularly user-friendly since it can be released "blindly" by the user and also with one hand.

According to a further preferred embodiment, the locking mechanism has a locking element in the first or second connector portion and a latching element in the second or first connector portion, wherein the locking element and/or the latching element can be deformed in a spring-elastic manner in a prespecified first direction and are/is designed to be rigid in a second direction which differs from the first direction.

This ensures that the locking element provides blocking on account of an action of force in the second direction and opening of the connector is not possible. For example, it is conceivable that the locking element is of rigid design in a direction perpendicular to the plane of the plug (referred to as the z-direction below) and is of elastic design within the plane of the plug. Consequently, the connector can be closed from several closing directions, but can be opened only from one direction or in one direction.

According to a further preferred embodiment, the locking element has a spring which is arranged in the first or the second connector portion, wherein the spring is designed in the form of an arc of a circle.

For example, the spring can be of C-shaped design. Therefore, the spring can expand during locking by the latching element, until the latching element latches behind a step of the C-shaped spring. As an alternative, the latching element can also be inserted laterally through the opening in the C-shaped spring, until it latches behind a step of the spring. In order to unlock the connector, the latching element is pulled or pushed laterally (in the opening direction) out of the opening in the C-shaped spring. Expansion of the spring on account of pulling on the latching element is blocked however.

As an alternative, it is conceivable for the step of the locking element to be sprung at the rear, as a result of which expansion of the locking element is likewise ensured.

According to a further preferred embodiment, the locking element can be elastically deformed by the latching element from several closing directions, and the latching element can be released by the locking element in precisely one opening direction or opening position. This ensures that the connector cannot be opened and closed in the same way.

For example, it is expedient to bevel or to round off the locking element and/or the spring from above and to design said locking element and/or spring with a sharp edge at the bottom. Therefore, the contour of the locking element permits expansion of the spring owing to an action of force from above (closing direction), whereas the spring cannot deform owing to an action of force from below.

According to a further preferred embodiment, the first connector portion is connected to a first, device-side printed circuit board and the second connector portion is connected to a second printed circuit board and/or to a cable. In this way, the electrical connector according to the invention connects an electrical device to a cable for power/data transmission. As an alternative, a connection can also be established between two printed circuit boards by virtue of the second printed circuit board being connected to an energy store or data carrier.

According to a further preferred embodiment, the first contact element is designed as at least one contact strip and/or the second contact element is designed as at least one contact pin or at least one bent contact. Said contact elements manufactured in a cost-effective manner and to have a particularly long service life.

According to a further preferred embodiment, the first and the second contact element each have a plurality of contact elements which are arranged in a manner horizontally offset in relation to one another, in particular not one behind the other. This arrangement ensures uniform utilization of the contact elements and therefore extends the service life of the connector.

According to a further preferred embodiment, the first connector portion and the second connector portion each have guide elements for guiding the first and, respectively, the second connector portion in the opening direction. The guide elements prevent tilting of the two connector portions and therefore facilitate operator control. This ensures that a user can reliably unlock the connector using one hand.

Fitting the connector according to the invention to a support which can be supported on the body is particularly expedient. The support can be fitted, for example, to a helmet. Therefore, electrical devices, for example headlamps, cameras or the like, can be fitted to a helmet in a particularly simple and secure manner.

The support according to the invention is suitable, in particular, as a support for electrical surgical apparatuses. For example, surgeons often wear metal "headbands" to which electrical apparatuses, for example surgical lamps, surgical microscopes or cameras, are fitted.

The above refinements and developments can, where appropriate, be combined with one another in any desired manner. Further possible refinements, developments and implementations of the invention also comprise not explicitly cited combinations of features of the invention that are described above or below in respect of the exemplary embodiments. In particular, a person skilled in the art will also add individual aspects in this case as improvements or additions to the respective basic form of the present invention.

BRIEF DESCRIPTION OF THE DRAWINGS

The present invention will be explained in greater detail below using the exemplary embodiments which are shown in the diagrammatic figures of the drawing, in which.

Figure 1:
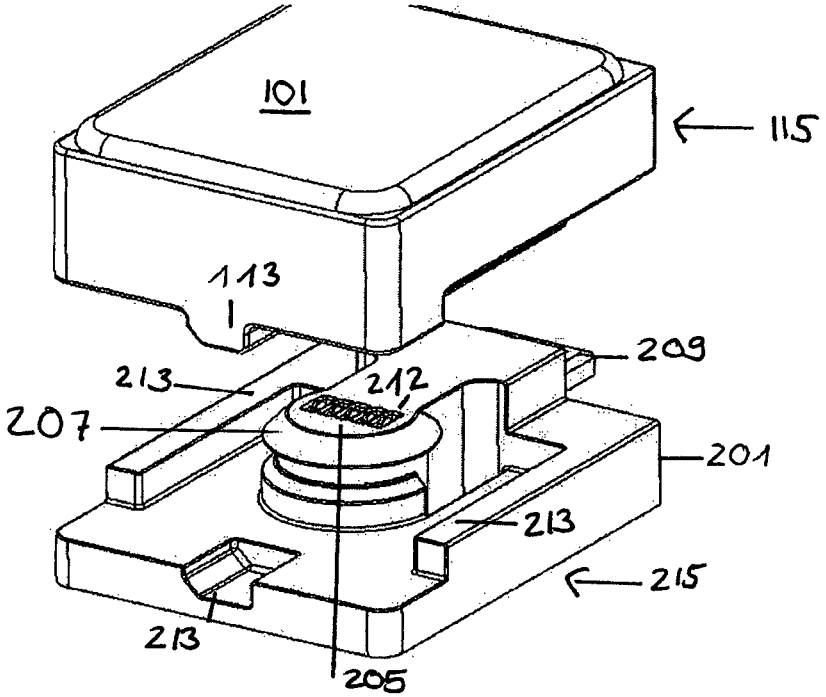
FIG. 1 shows a first connector portion and a second connector portion in line with one embodiment according to the invention immediately before an electrical connection is established.

The accompanying figures of the drawing are intended to provide a further understanding of the embodiments of the invention. They illustrate embodiments and, in conjunction with the description, serve to explain principles and concepts of the invention. Other embodiments and many of the advantages mentioned become apparent in view of the drawings. The elements shown in the drawings are not necessarily shown true to scale in relation to one another.

In the figures of the drawing, identical, functionally identical and identically acting elements, features and components are respectively provided with the same reference symbols—unless stated otherwise.

DESCRIPTION OF EXEMPLARY EMBODIMENTS

The drawings are described below in an interrelated and comprehensive manner.

FIG. 1 shows a perspective view of an electrical connector 100 according to the invention during closing. The connectors 100 has a first connector portion 101, a second connector portion 201 and a locking mechanism (107, 109, 207).

The first connector portion 101 can be mounted, for example, on a printed circuit board. The second connector portion has a printed circuit board 209 which serves as a data memory. For the purpose of power and data transmission between the two connector portions 101, 201, said connector portions have contact elements 103, 203.

The connector 100 is of self-locating design. For this purpose, the connector portions 101, 201 each have a magnet 105, 205.

In FIG. 1, the connector is closed in direction (−)z. However, the connector cannot be opened in direction +z.

Figure 2:
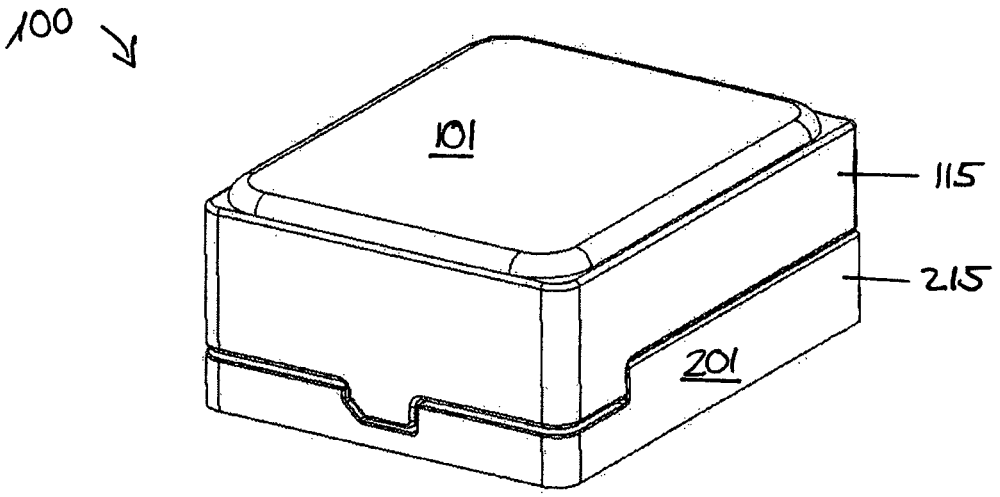
FIG. 2 shows a perspective view of an electrical connector in line with one embodiment according to the invention.

FIG. 2 shows an electrical connectors 100 according to FIG. 1 in a closed state. Said FIG. 2 shows that the electrical connectors 100 has a particularly compact form and also a homogeneous geometry. Therefore, only the housings 115, 215 of the two connector portions 101, 201 and also possible printed circuit board or cable connections of the connector portions are accessible in the closed state. The smooth, planar condition prevents dirt or germs accumulating on the surface of the connector. In addition, the connector is particularly easy to clean and to sterilize. Therefore, the compact form is particularly advantageous in respect of hygiene.

In FIG. 2, the second connector portion 201 can be connected to a cable by means of a cable connection (not illustrated) for power and data transmission.

Figure 3:
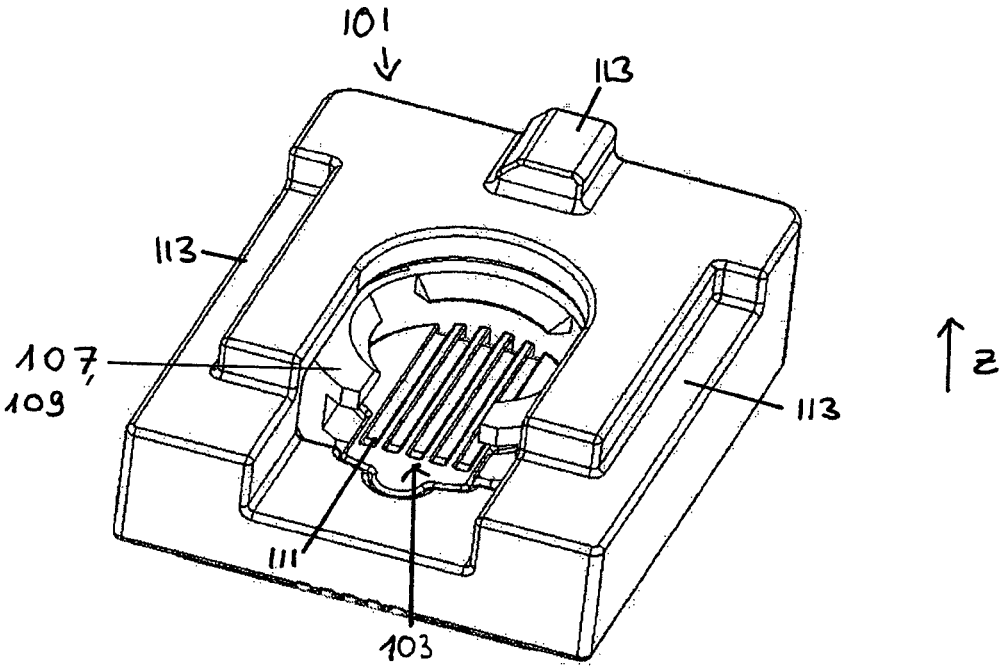
FIG. 3 shows a perspective view of a first connector portion in line with a further embodiment according to the invention.

FIG. 3 illustrates the first connector portion 101*a* in a diagrammatic perspective view. The connector portion 101*a* comprises an electrical contact element 103 with a plurality of stamped contact strips 111. A magnet 105 (not illustrated) is located beneath the contact element 103 and is concealed by it.

The connector portion 101*a* in FIG. 3 comprises a locking element 107*a* which is of substantially rigid design. The locking element 107 has a groove 117 through which a latching element of a second connector portion can be pushed out (and pushed in). FIG. 3 shows that the locking element 107*a* is bounded by a recess of the housing 115. The boundary lends the locking element 107*a* a degree of rigidity and prevents expansion of the locking element 107*a*. The locking element 107*a* has beveled side faces 119 at its top side. Owing to an action of force or pressure from above, the beveled side faces give way downward to a certain extent. The side faces on the inner side of the groove 117 are of right-angled design in such a way that a latching element of a second connector portion tilts with the locking element 107*a* when pulled from above or in the z-direction.

Furthermore, the connector portion 101*a* in FIG. 3 has a plurality of guide elements 113. The guide elements 113 guide the first and, respectively, the second connector portion during opening of the connectors. Therefore, the guide elements 113 prevent tilting during opening of the second connector portion in the locking element 117 by virtue of the latching element of the second connector portion being guided laterally or in the y-direction out of the locking element 107*a* owing to an action of force by the guide elements 113 during opening.

Figure 4:
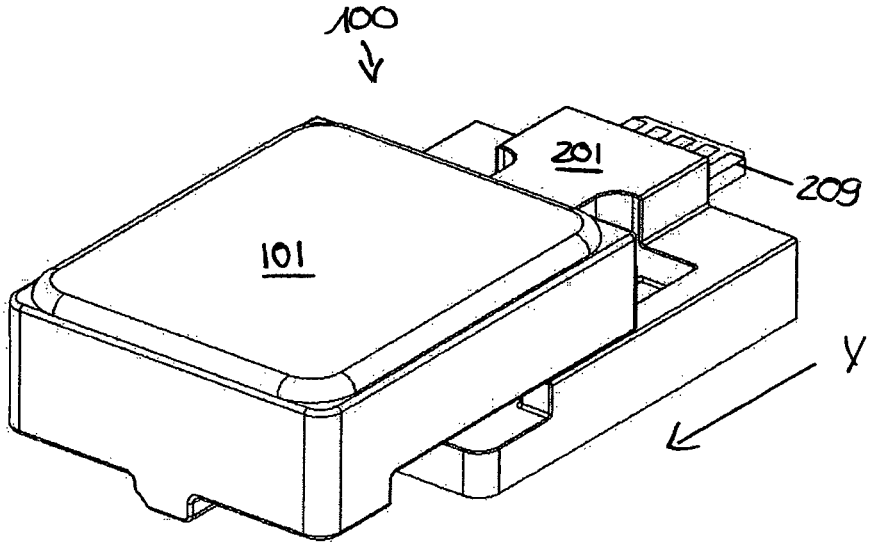
FIG. 4 shows a perspective view of a in line with further an embodiment according to the invention electrical connector during opening.

FIG. 4 shows the connector 100 during opening by way of a user moving the first connector portion 101 in the Y-direction, away from the second connector portion 201.

Figure 5:
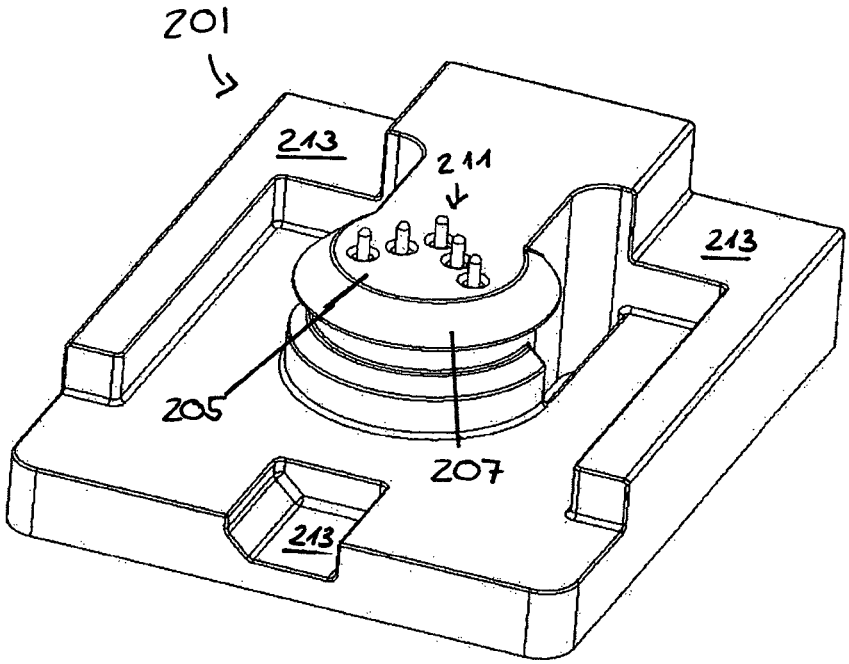
FIG. 5 shows a perspective view of a second connector portion according to the invention in line with a first embodiment.
Figure 6:
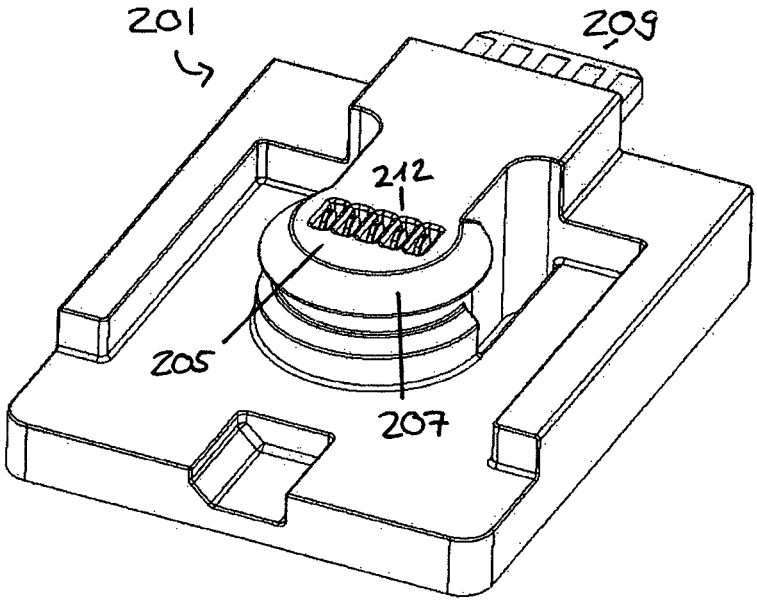
FIG. 6 shows a perspective view of a second connector portion according to the invention in line with a second embodiment.

FIGS. 5 and 6 each show a second connector portion 201*a, b* with electrical contact elements 203. In FIG. 5, the electrical contact elements 203 are designed as contact pins 211. In FIG. 6, the electrical contact element 203 are designed as stamped, bent contacts 212. A C-shaped latching element 207*a* is formed around the contact elements 211, 212. A semicircular magnet 205 is arranged beneath the latching element 207*a*.

It has already been explained above with reference to FIG. 3 that the locking element 107*a* of the connector portion 101*a* in FIG. 3 is of substantially rigid design. Accordingly, the C-shaped latching element 207*a* can be deformed in a spring-elastic manner the way the a connection can be established not only by laterally inserting the second connector portion into the first connector portion, but rather also by said connector portions being plug-connected from above or below. For this purpose, the C-shaped latching element 207*a* is sprung at the rear in such a way that it can deform inward owing to an action of force from above. Therefore, the latching element 207*a* forms a spring.

Springing of the latching element 207*a* at the rear is not illustrated in FIGS. 5 and 6. Expedient springing at the rear can be performed by a flexible fastening in front of a hollow space or, for example, in front of a compressible elastomeric foam.

In order to facilitate plug-connection of the connector, the latching element 207*a* has beveled surfaces at its top side which is directed toward the interface. In order to prevent a connector from being released on account of being pulled, the latching element 207*a* is of right-angled design at its bottom side.

The two connector portions 201*a, b* are compatible with a first connector portion 101*a*, for example according to FIG. 3. Accordingly, the connector portions 201*a, b* have guide elements 213 which correspond to the guide elements 113.

It goes without saying that the selection of contact elements is not restricted to a specific embodiment according to the invention or to the first or second connector portion, but rather can be combined in any desired manner.

Figure 7:
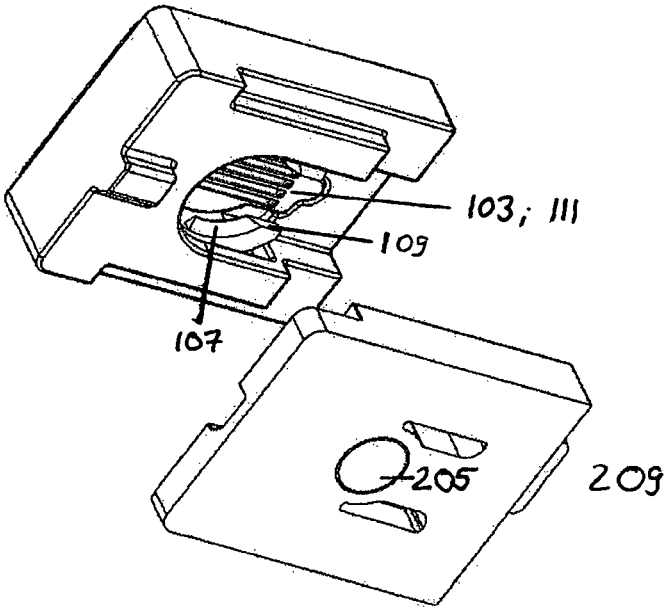
FIG. 7 shows a perspective view, from the bottom, of a first connector portion and of a second connector portion in line with a further embodiment according to the invention immediately before an electrical connection is established.
Figure 8:
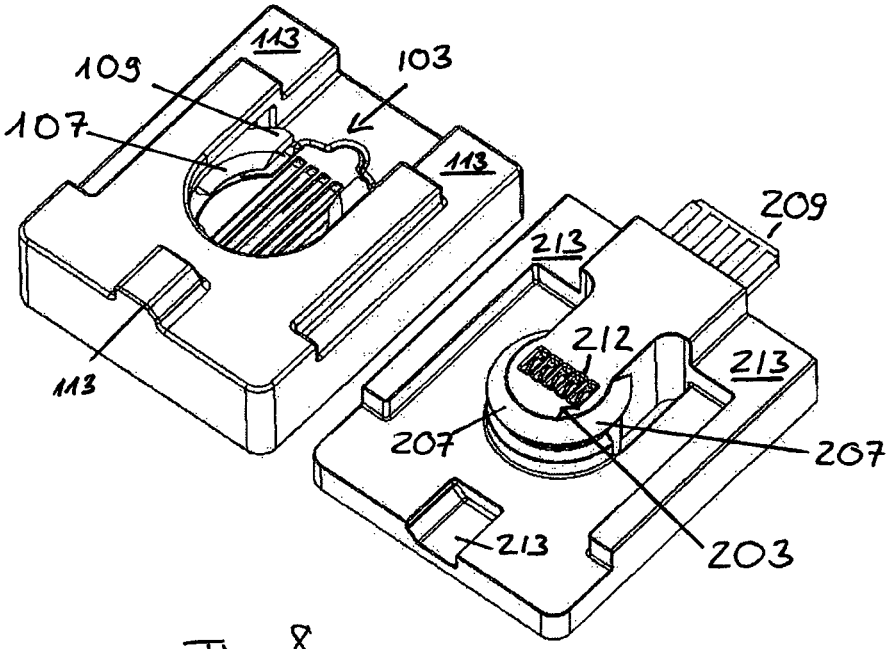
FIG. 8 shows a perspective view of a first connector portion and of a second connector portion in line with a further embodiment according to the invention.

FIGS. 7 and 8 show a further alternative embodiment of the present invention. A first connector portion 101*c* and also a second connector portion 201*b* are illustrated in each of FIGS. 7 and 8. The connector portions 101*c* and 201*c* differ from the connector portions 101*a*, 201*a* owing to their latching element 207*c* and locking element 107*c*.

FIGS. 7 and 8 show that the locking element 107*c* is partially arranged in a recess 119. Therefore, the locking element 107*c* can expand owing to an action of force from above by the latching element 207*c* during the process of plug-connecting the connector. In order to facilitate expansion of the locking element 107*c*, the locking element 107*c* and also the latching element 207*c* have beveled surfaces on their top side.

Owing to the adequate spring-elastic properties of the locking element 107*c*, the latching element 207*c* is of substantially rigid design and designed without spring-elastic properties.

In FIGS. 7 and 8, the locking element 107*c* has a C-shaped main structure. Further elements which are in the form of an arc of a circle are arranged on the inside of the C-shaped main structure. Even though this is not illustrated in the figures, it is conceivable to provide the elements which are in the form of an arc of a circle with springs from behind, similarly to the manner which has been described in FIGS. 5 and 6 with respect to the C-shaped latching element 207*a*.

FIG. 7 additionally shows that the semicircular magnet 205 is strengthened by a magnetic disk 206.

Although the present invention has been fully described above with reference to preferred exemplary embodiments, it is not limited thereto but rather can be modified in a variety of ways.

LIST OF REFERENCE SYMBOLS

100 Electrical connector
101 First connector portion in line with a general embodiment
101*a* First connector portion
101*c* First connector portion
103 Contact element
105 Magnet
107 Locking element
107*a* Locking element
107*c* Locking element
109 Spring
111 Contact strip
113 Guide elements
115 Housing
117 Groove
119 Recess
201 Second connector portion in line with a general embodiment
201*a* Second connector portion
201*b* Second connector portion
201*c* Second connector portion
203 Contact element
205 Magnet
206 Magnetic disk
207 Latching element
207*a* Latching element
207*c* Latching element
208 Spring
209 Printed circuit board
211 Contact pin
212 Bent contact
213 Guide elements
215 Housing

The invention claimed is:

1. An electrical connector, comprising:

a base portion comprising a first magnet and a first plurality of electrically conductive contacts; and a lid portion comprising a second magnet and a second plurality of electrically conductive contacts, said second magnet being of opposite polarity to said first magnet, wherein said base portion and said lid portion are shaped such that said base portion receives said lid portion in a first direction, inhibits separation of said lid portion from said base portion in a second direction opposite said first direction, and permits separation of said lid portion from said base portion in a third direction different from said second direction, in an engaged state, said lid portion and said base portion form an enclosure that substantially encloses said first plurality of electrically conductive contacts and said second plurality of electrically conductive contacts, said base portion and said lid portion are shaped such that a reception of said lid portion by said base portion in said first direction effects, as a direct result of a motion in said first direction, a connecting of said first plurality of electrically conductive contacts and said second plurality of electrically conductive contacts, and said separation of said lid portion from said base portion in a third direction comprises a disconnecting of said first plurality of electrically conductive contacts from said second plurality of electrically conductive contacts.

2. The electrical connector of claim 1, wherein:

said third direction is substantially perpendicular to said first direction.

3. The electrical connector of claim 1, wherein:

said base portion and said lid portion are shaped such that said base portion inhibits separation of said lid portion from said base portion in any direction other than said third direction.

4. The electrical connector of claim 1, wherein:

said base portion and said lid portion are shaped such that said base portion receives said lid portion in a first direction from a first unengaged state to said engaged state, inhibits separation of said lid portion from said base portion in a second direction opposite said first direction from said engaged state to said first unengaged state, and permits separation of said lid portion from said base portion in a third direction different from said second direction from said engaged state to a second unengaged state.

5. The electrical connector of claim 1, wherein:

in said engaged state, a first contact of said first plurality of electrically conductive contacts contacts a second contact of said second plurality of electrically conductive contacts, and a third contact of said first plurality of electrically conductive contacts contacts a fourth contact of said second plurality of electrically conductive contacts.

6. The electrical connector of claim 1, wherein:

at least one of said base portion and said lid portion comprises an arcuate retention element, and said arcuate retention element defines an arc of greater than 180°.

7. The electrical connector of claim 6, wherein:

said arcuate retention element contributes to said inhibiting of separation of said lid portion from said base portion in a second direction opposite said first direction.

8. An electrical connector, comprising:

a base portion comprising a first magnet and a first plurality of electrically conductive contacts; and a lid portion comprising a second magnet and a second plurality of electrically conductive contacts, said second magnet being of opposite polarity to said first magnet, wherein said base portion and said lid portion are shaped such that said base portion receives said lid portion in a first direction, permits separation of said lid portion from said base portion in a second direction opposite said first direction in a first orientation of said lid portion relative to said base portion, and inhibits separation of said lid portion from said base portion in said second direction in at least one rotational orientation of said lid portion relative to said base portion different from said first orientation, and said base portion and said lid portion are shaped such that, in said at least one rotational orientation of said lid portion relative to said base portion, said lid portion is receivable by said base portion in said first direction.

9. The electrical connector of claim 8, wherein:

in an engaged state, said lid portion and said base portion form an enclosure that substantially encloses said first plurality of electrically conductive contacts and said second plurality of electrically conductive contacts.

10. The electrical connector of claim 8, wherein:

said base portion and said lid portion are shaped such that said base portion receives said lid portion in a first direction from a first unengaged state to an engaged state, permits separation of said lid portion from said base portion from said engaged state to a second unengaged state in a second direction opposite said first direction in a first orientation of said lid portion relative to said base portion, and inhibits separation of said lid portion from said base portion from said engaged state to said first unengaged state in said second direction in at least one orientation of said lid portion relative to said base portion different from said first orientation.

11. The electrical connector of claim 8, wherein:

said base portion and said lid portion are shaped such that said base portion inhibits separation of said lid portion from said base portion in said second direction in any orientation of said lid portion relative to said base portion different from said first orientation.

12. The electrical connector of claim 8, wherein:

said base portion and said lid portion are shaped such that said base portion receives said lid portion in a first direction from a first unengaged state to an engaged state, permits separation of said lid portion from said base portion from said engaged state to a second unengaged state in a second direction opposite said first direction in a first orientation of said lid portion relative to said base portion, and inhibits separation of said lid portion from said base portion from said engaged state to an unengaged state different from said second unengaged state in said second direction in any orientation of said lid portion relative to said base portion different from said first orientation.

13. The electrical connector of claim 8, wherein:

in an engaged state, a first contact of said first plurality of electrically conductive contacts contacts a second contact of said second plurality of electrically conductive contacts, and a third contact of said first plurality of electrically conductive contacts contacts a fourth contact of said second plurality of electrically conductive contacts.

14. The electrical connector of claim 8, wherein:

at least one of said base portion and said lid portion comprises an arcuate retention element, and said arcuate retention element defines an arc of greater than 180°.

15. The electrical connector of claim 14, wherein:

said arcuate retention element contributes to said inhibiting of separation of said lid portion from said base portion in said second direction in at least one orientation of said lid portion relative to said base portion different from said first orientation.

16. An electrical connector, comprising:

a first connector portion comprising a first magnet and a first plurality of electrically conductive contacts;

a second connector portion comprising a second magnet and a second plurality of electrically conductive contacts, said second magnet being of opposite polarity to said first magnet; and an arcuate retention element that, in an engaged state of said first connector portion and said second connector portion, inhibits separation of said first connector portion from said second connector portion, wherein said arcuate retention element defines an arc of greater than 180°.

17. The electrical connector of claim 16, wherein:

said first connector portion and said second connector portion are shaped such that said first connector portion receives said second connector portion in a first direction, inhibits separation of said second connector portion from said first connector portion in a second direction opposite said first direction, and permits separation of said second connector portion from said first connector portion in a third direction different from said second direction.

18. The electrical connector of claim 17, wherein:

said third direction is substantially perpendicular to said first direction.

19. The electrical connector of claim 17, wherein:

said first connector portion and said second connector portion are shaped such that said base portion inhibits separation of said second connector portion from said first connector portion in any direction other than said third direction.

20. The electrical connector of claim 16, wherein:

in said engaged state, said second connector portion and said first connector portion form an enclosure that substantially encloses said first plurality of electrically conductive contacts and said second plurality of electrically conductive contacts.

21. An electrical connector, comprising:

a base portion comprising a first magnet and a first plurality of electrically conductive contacts; and a lid portion comprising a second magnet and a second plurality of electrically conductive contacts, said second magnet being of opposite polarity to said first magnet, wherein said base portion and said lid portion are shaped such that said base portion receives said lid portion in a first direction, inhibits separation of said lid portion from said base portion in a second direction opposite said first direction, and permits separation of said lid portion from said base portion in a third direction different from said second direction, in an engaged state, said lid portion and said base portion form an enclosure that substantially encloses said first plurality of electrically conductive contacts and said second plurality of electrically conductive contacts, a receiving of said lid portion by said base portion in said first direction entails a deformation of at least one of said lid portion and said base portion, said separation of said lid portion from said base portion in a third direction comprises a disconnecting of said first plurality of electrically conductive contacts from said second plurality of electrically conductive contacts, and said separation of said lid portion from said base portion in a third direction comprises moving said lid portion in said third direction relative to said base portion to a position in which said lid portion is significantly distanced from said base portion.

22. An electrical connector, comprising:

a base portion comprising a first magnet and a first plurality of electrically conductive contacts; and a lid portion comprising a second magnet and a second plurality of electrically conductive contacts, wherein said first magnet and said second magnet are arranged such that said base portion attracts said lid portion generally toward an engaged state, said base portion and said lid portion are shaped such that said lid portion is movable, by a linear motion in a first direction relative to said base portion, from a non-engaged state to said engaged state, said base portion and said lid portion are shaped such that said base portion inhibits separation of said lid portion from said base portion by a motion of said lid portion relative to said base in a second direction opposite said first direction, said base portion and said lid portion are shaped such that said base portion permits separation of said lid portion from said base portion by a motion of said lid portion relative to said base in a third direction different from said second direction, in said non-engaged state, said lid portion does not contact said base portion, in said engaged state, said lid portion and said base portion form an enclosure that substantially encloses said first plurality of electrically conductive contacts and said second plurality of electrically conductive contacts, said base portion and said lid portion are shaped such that said linear motion of said lid portion in said first direction relative to said base portion effects a connecting of said first plurality of electrically conductive contacts and said second plurality of electrically conductive contacts, and said separation of said lid portion from said base portion in a third direction comprises a disconnecting of said first plurality of electrically conductive contacts from said second plurality of electrically conductive contacts.

* * * * *